US010786695B2

(12) United States Patent
Gabriel

(10) Patent No.: US 10,786,695 B2
(45) Date of Patent: Sep. 29, 2020

(54) PROTECTIVE RESPIRATORY MASK WITH ELECTRONIC SYSTEM

(71) Applicant: Pamela Gabriel, Greenwich, CT (US)

(72) Inventor: Pamela Gabriel, Greenwich, CT (US)

(73) Assignee: The SmartMask LLC, Greenwich, CT (US)

( * ) Notice: Subject to any disclaimer, the term of this patent is extended or adjusted under 35 U.S.C. 154(b) by 394 days.

(21) Appl. No.: 15/984,597

(22) Filed: May 21, 2018

(65) Prior Publication Data

US 2018/0280738 A1 Oct. 4, 2018

Related U.S. Application Data

(63) Continuation-in-part of application No. 14/334,207, filed on Jul. 17, 2014, now abandoned.

(60) Provisional application No. 61/847,385, filed on Jul. 17, 2013.

(51) Int. Cl.

| | |
|---|---|
| ***A62B 18/08*** | (2006.01) |
| ***A62B 18/02*** | (2006.01) |
| ***A62B 23/02*** | (2006.01) |
| *A41D 13/11* | (2006.01) |

(52) U.S. Cl.

CPC ..... *A62B 18/08* (2013.01); *A62B 18/025* (2013.01); *A62B 23/025* (2013.01); *A41D 13/11* (2013.01); *A41D 13/1138* (2013.01); *A41D 13/1161* (2013.01)

(58) Field of Classification Search

CPC ..... A62B 18/025; A62B 18/08; A62B 18/10; A62B 23/02; A62B 23/025; A41D 13/11; A41D 13/1138; A41D 13/1161

See application file for complete search history.

(56) References Cited

U.S. PATENT DOCUMENTS

| | | | | | |
|---|---|---|---|---|---|
| 2,281,181 | A | | 4/1942 | Clarke | |
| 3,474,783 | A | * | 10/1969 | Ulmann | F16K 15/148 128/206.15 |
| 3,575,206 | A | * | 4/1971 | Ulmann | A62B 18/10 137/529 |
| 4,354,520 | A | * | 10/1982 | Easley, Jr. | A62B 18/10 128/205.24 |
| 4,520,509 | A | | 6/1985 | Ward | |
| 5,078,130 | A | * | 1/1992 | Van Oosten | A62B 18/04 128/201.24 |
| 5,299,448 | A | * | 4/1994 | Maryyanek | A62B 27/00 73/40 |
| 5,419,318 | A | | 5/1995 | Tayebi | |

(Continued)

*Primary Examiner* — Kathryn E Ditmer

(74) *Attorney, Agent, or Firm* — St. Onge Steward Johnston & Reens LLC

(57) ABSTRACT

A wearable protective respiratory mask with an attachable electronic system and an attachable gas filter system is provided. The mask may be easily disassembled for cleaning and maintenance. The attachable electronic system includes a functionality for communication with an external electronic system, and a control unit for controlling the attachable electronic system. The attachable gas filter system includes a plurality of components, including an adjustable valve system. The mask may act as a barrier for inhibiting transfer of one or more components of a gaseous composition. The mask is useful for individuals in a variety of environments, including environments with potentially harmful aerosols, vapors, particulates, or sounds.

10 Claims, 9 Drawing Sheets

(56) References Cited

U.S. PATENT DOCUMENTS

| | | | | |
|---|---|---|---|---|
| 5,467,765 | A | 11/1995 | Maturaporn | |
| 5,561,863 | A | 10/1996 | Gerald | |
| 5,717,991 | A | 2/1998 | Nozaki et al. | |
| 5,819,731 | A | 10/1998 | Dyrud et al. | |
| 6,176,576 | B1 | 1/2001 | Green et al. | |
| 7,044,131 | B2 | 5/2006 | Griesbach et al. | |
| 7,313,246 | B2 | 12/2007 | Miller et al. | |
| 7,488,068 | B2 | 2/2009 | Welchel et al. | |
| 7,620,429 | B1 | 11/2009 | Frerking et al. | |
| 7,836,887 | B1 | 11/2010 | Kling | |
| 7,866,319 | B2 * | 1/2011 | Penton | A62B 7/04 128/205.24 |
| 7,958,889 | B1 * | 6/2011 | Fernandez-DeCastro | A62B 18/086 128/202.15 |
| 8,240,302 | B1 | 8/2012 | Tayebi et al. | |
| 8,939,769 | B2 | 1/2015 | Yoo et al. | |
| 9,036,847 | B2 | 5/2015 | Han et al. | |
| 9,517,367 | B2 * | 12/2016 | Dwyer | A62B 18/10 |
| 9,707,444 | B1 * | 7/2017 | Danford | A63B 23/18 |
| 10,322,312 | B1 * | 6/2019 | Danford | A63B 23/0355 |
| 2007/0248238 | A1 | 10/2007 | Abreu | |
| 2010/0132714 | A1 * | 6/2010 | Morelli | A62B 27/00 128/206.21 |
| 2010/0319714 | A1 | 12/2010 | Oshima et al. | |
| 2012/0247474 | A1 * | 10/2012 | Torbenson | A62B 18/086 128/206.15 |
| 2013/0047995 | A1 | 2/2013 | Shibata et al. | |
| 2017/0333749 | A1 * | 11/2017 | McKeown | A61B 5/6803 |
| 2018/0078798 | A1 * | 3/2018 | Fabian | A62B 7/10 |
| 2018/0296876 | A1 * | 10/2018 | Wenger | A63B 21/4003 |

* cited by examiner

PROTECTIVE RESPIRATORY MASK WITH ELECTRONIC SYSTEM

CROSS REFERENCE TO RELATED APPLICATIONS

This is a continuation-in-part application of Nonprovisional patent application Ser. No. 14/334,207 filed on Jul. 17, 2014, which claims priority under 35 U.S.C. § 119(e) to U.S. Provisional Application No. 61/847,385 filed on Jul. 17, 2013. The above identified patent applications are incorporated by reference herein in their entirety to provide continuity of disclosure.

BACKGROUND OF THE INVENTION

Protective respiratory masks are worn by individuals for a plurality of reasons in many different environments. Generally, respiratory masks provide protection to the respiratory pathway and portions of the face of a wearer. Protective respiratory masks are deployed in situations in which there is a gaseous hazard originating from inside the wearer, to prevent the spread of the gaseous hazard to another individual or to the environment. They are also deployed in situations in which there is a gaseous hazard originating from outside the wearer, such as from another individual or from the environment. Respiratory masks may have one or more gas filters which may be rated or designated for a particular use, for example, filtering of coarse or fine particulates, filtering of chemical fumes or vapors, or filtering of biological substances.

Conventional protective respiratory masks are poorly-fitting because generally, they are available in one size. As a result, many of these masks are not configured to conform to the contours of a wearer's face, resulting in an inadequate gaseous barrier or seal between the external environment of the mask and the interior space of the mask. This can be hazardous to the individual wearing the mask, hazardous to an individual in the environment, or hazardous to both the individual wearing the mask and the individual in the environment. In addition, many conventional protective respiratory masks are single use only, causing high waste and high cost to replace the masks during usage.

Furthermore, an individual wearing a conventional protective respiratory mask may need to utilize an electronic device while performing a task that requires the individual to wear the respiratory mask. The mask may interfere with the ability of the individual to use the electronic device for at least several reasons, such as risk of contamination of an article or subject with a substance originating from the electronic device, risk of spreading a hazardous substance of an article or subject through the electronic device by way of touching the electronic device, or risk of distraction caused by the electronic device.

Therefore, there is a need in the art for an improved protective respiratory mask with an electronic system. The present invention addresses this unmet need.

FIELD OF THE INVENTION

The present invention relates to a modular, wearable protective respiratory mask having an electronic system which may be attached to the mask.

Devices have been disclosed in the art that relate to wearable protective respiratory masks. These include devices that have been patented and published in patent application publications. In view of the devices disclosed in the art, it is submitted that there is a need in the art for an improvement to existing wearable protective respiratory masks. In view of the present disclosure, it is submitted that the present invention substantially diverges in structural and functional elements from devices in the art, and the instant invention substantially fulfills an unmet need in the art.

SUMMARY OF THE INVENTION

In view of the disadvantages inherent in the known types of wearable protective respiratory masks in the art, the present invention provides a new and improved modular, wearable protective respiratory mask with an associated electronic system, wherein the same can be utilized for providing convenience to a user when performing an activity that requires effective protection to the user or another individual from gaseous or airborne hazardous substances.

It is therefore an object of the present invention to provide a new and improved modular, wearable protective respiratory mask.

It is another object of the present invention to provide a new and improved modular, wearable protective respiratory mask with an associated electronic system to facilitate use of an external electronic device while wearing the protective respiratory mask.

Another object of the present invention is to provide means for hands-free use of or communication with an external electronic device by way of an electronic system associated with the protective mask.

Yet another object of the present invention is to provide a new and improved method of operating an electronic device while wearing a protective respiratory mask.

Another object of the present invention is to provide a protective respiratory mask that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

Figure 3:
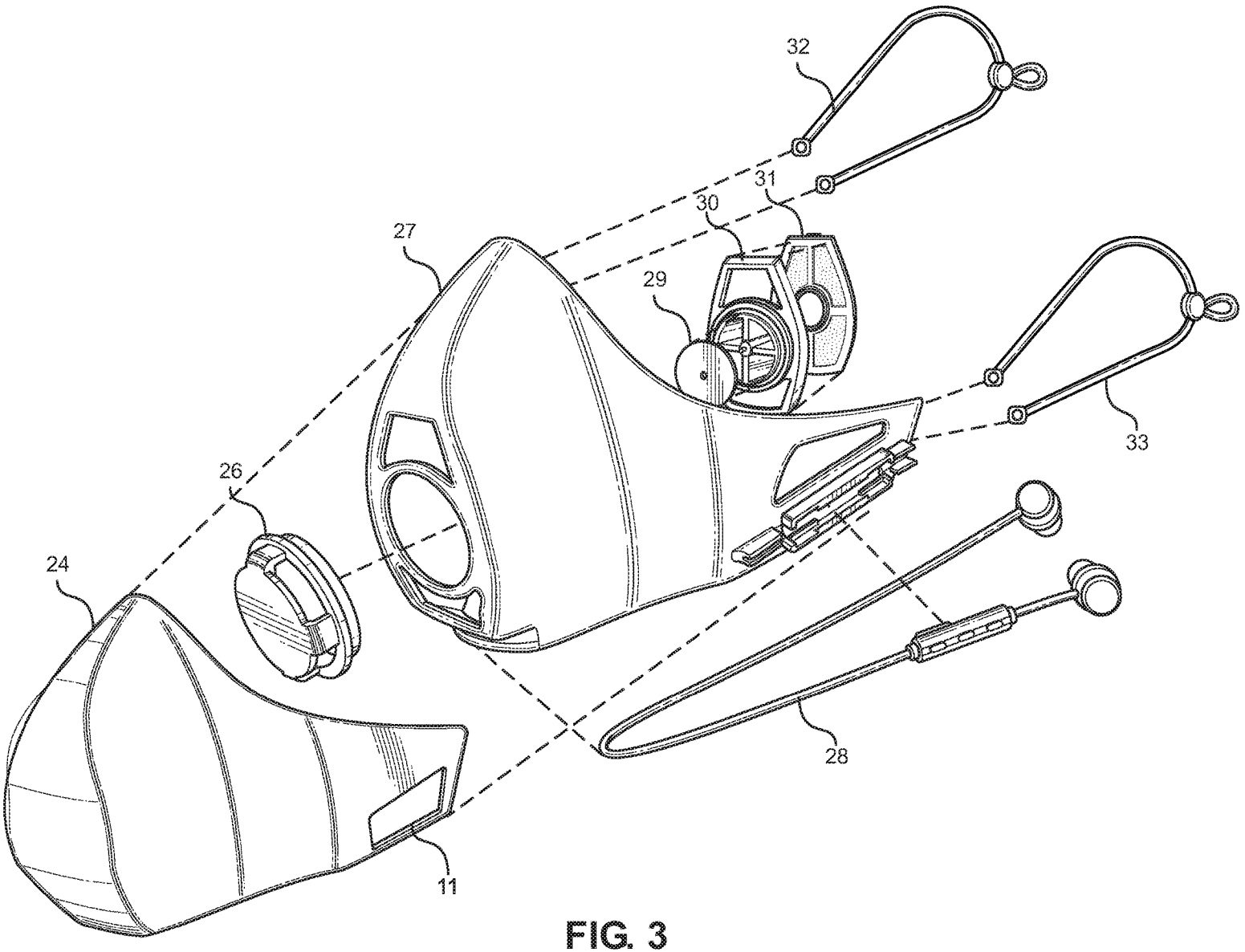

FIG. 3 depicts an exploded view of an exemplary unassembled wearable protective respiratory mask having an electronic system with earpieces. In the example depicted, the ear straps are removed from the mask frame. Broken lines depict how the components of the mask fit together during assembly.

Figure 4:
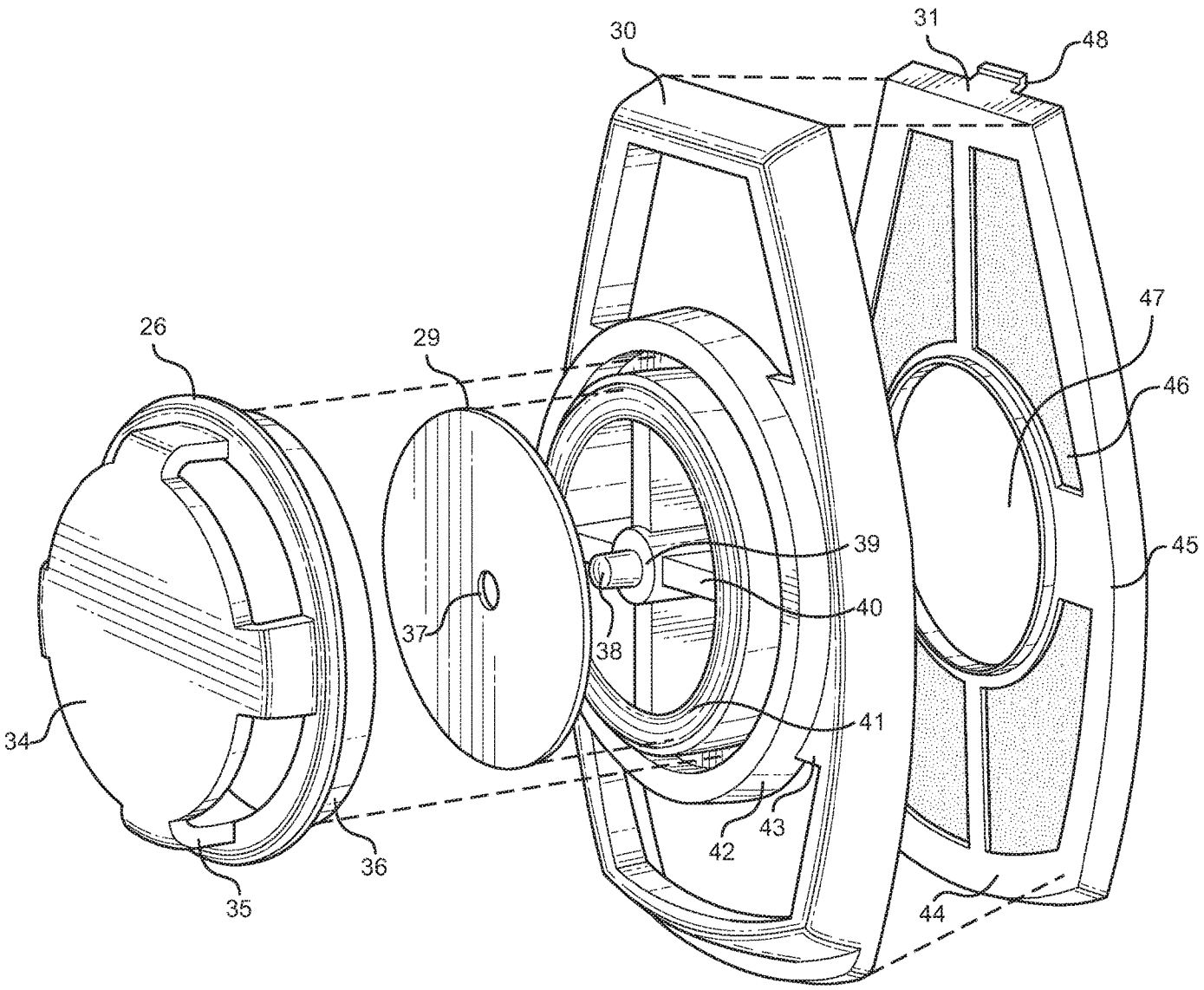

FIG. 4 depicts an exploded view of an exemplary unassembled gas filter system. In the example depicted, the dotted lines depict that the outer valve cover reversibly engages with the valve frame. Broken lines depict how the components of the gas filter system fit together during assembly.

Figure 5:
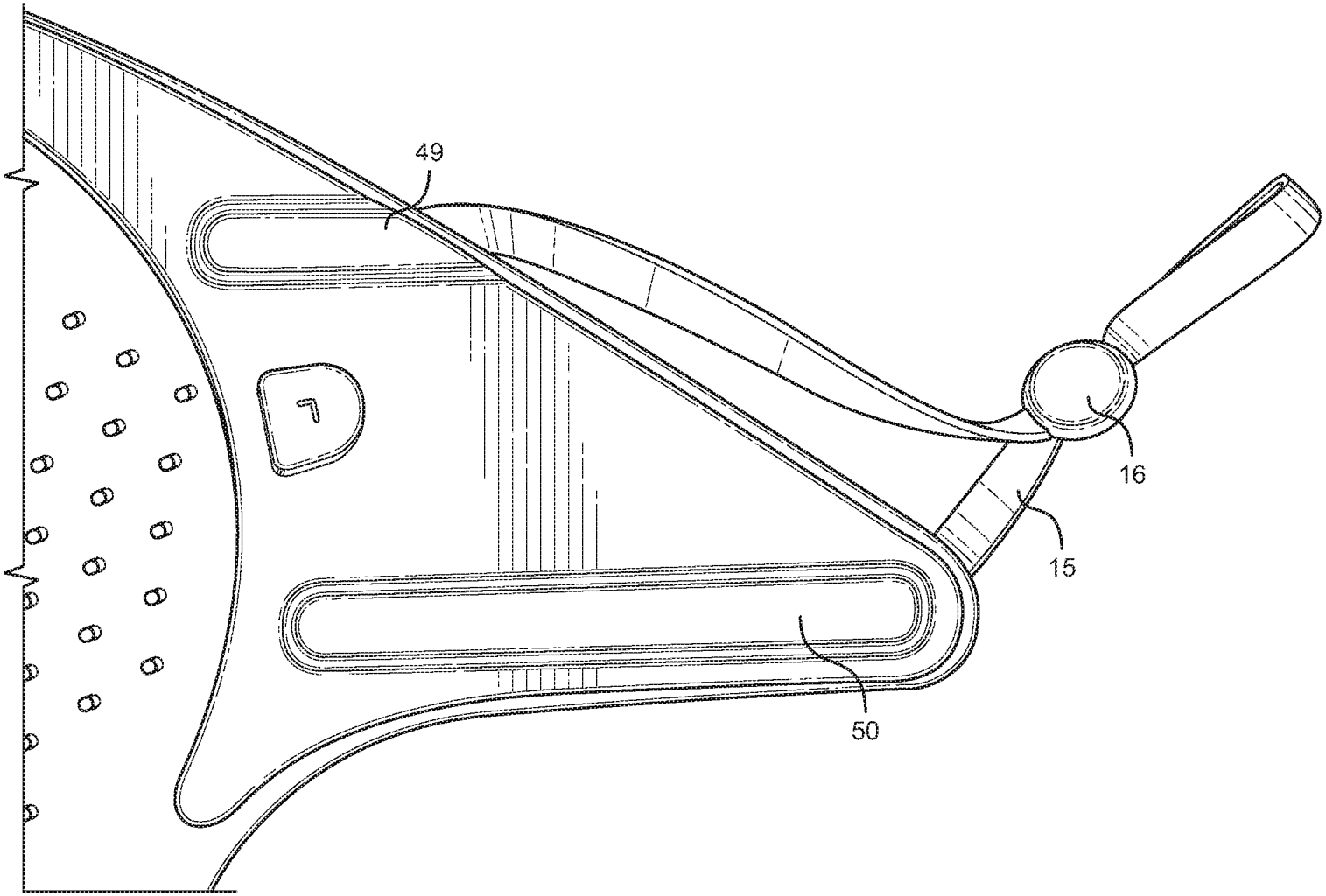

FIG. 5 depicts a detailed view of an exemplary ear strap attachment site, wherein the mask frame surface facing the viewer is a left inner surface of the mask frame. In the example depicted, the ear strap is permanently or semi-permanently attached to the mask frame by way of a top ear strap insert and a bottom ear strap insert.

Figure 6:
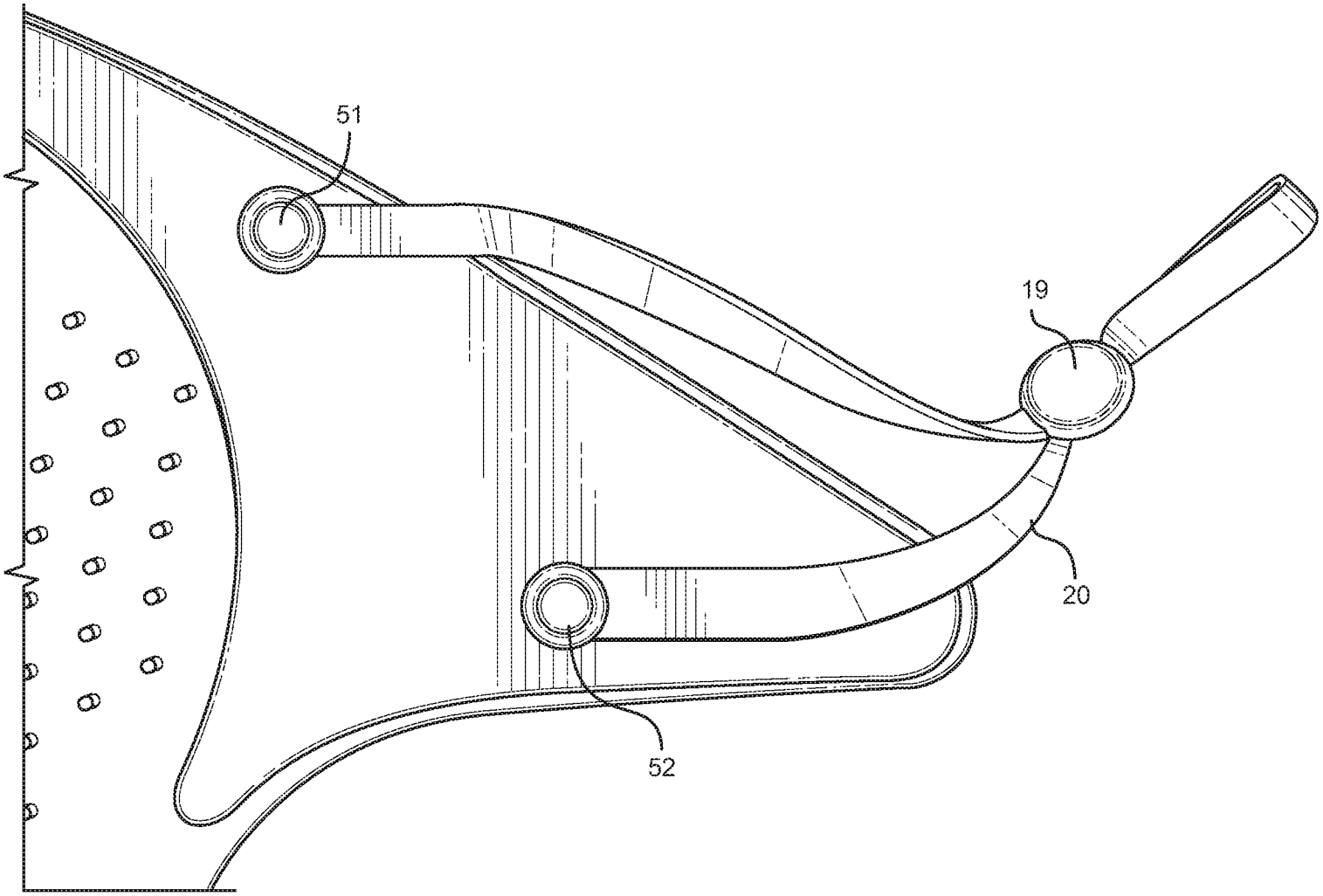

FIG. 6 depicts a detailed view of an exemplary ear strap attachment site, wherein the mask frame surface facing the viewer is a right outer surface of the mask frame. In the example depicted, the ear strap is removably attached to the mask frame by way of a top ear strap button and a bottom ear strap button.

Figure 7:
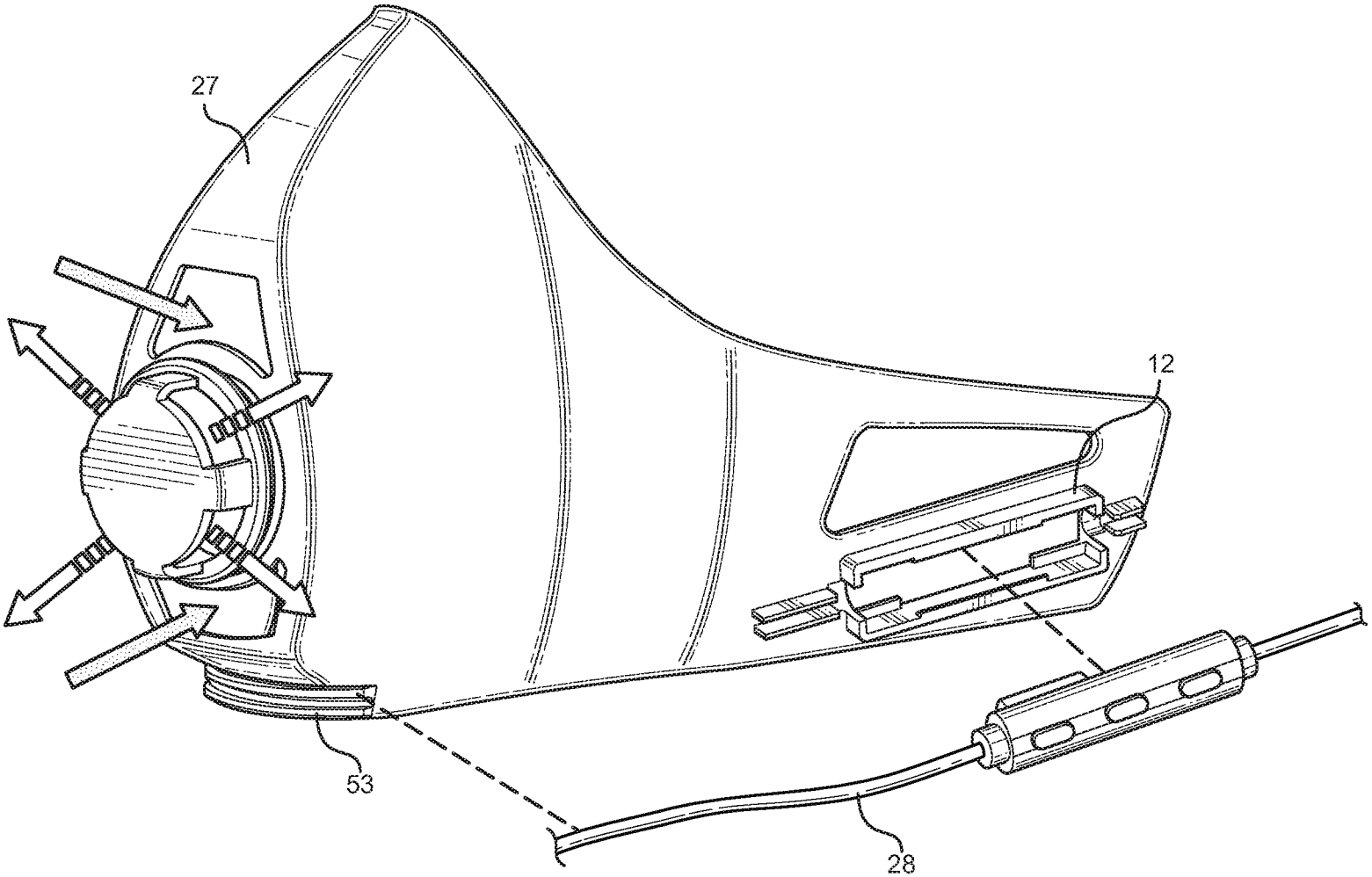

FIG. 7 depicts a perspective view of an exemplary partially assembled wearable protective respiratory mask, wherein the gas filter system is in the open position. Broken lines depict how the electronic system fits into the mask frame.

Figure 8:
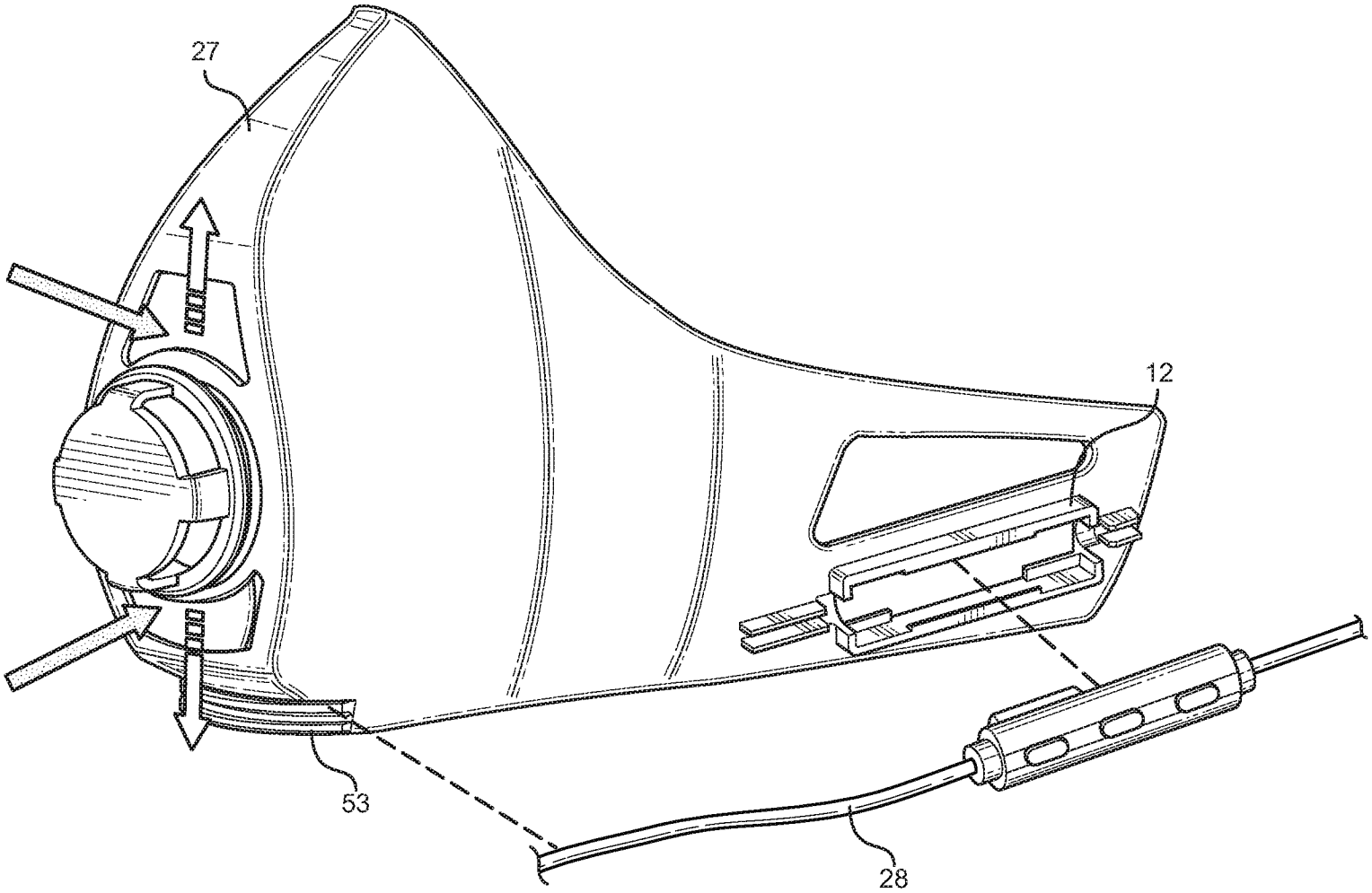

FIG. 8 depicts a perspective view of an exemplary partially assembled wearable protective respiratory mask, wherein the gas filter system is in the closed position. Broken lines depict how the electronic system fits into the mask frame.

Figure 9:
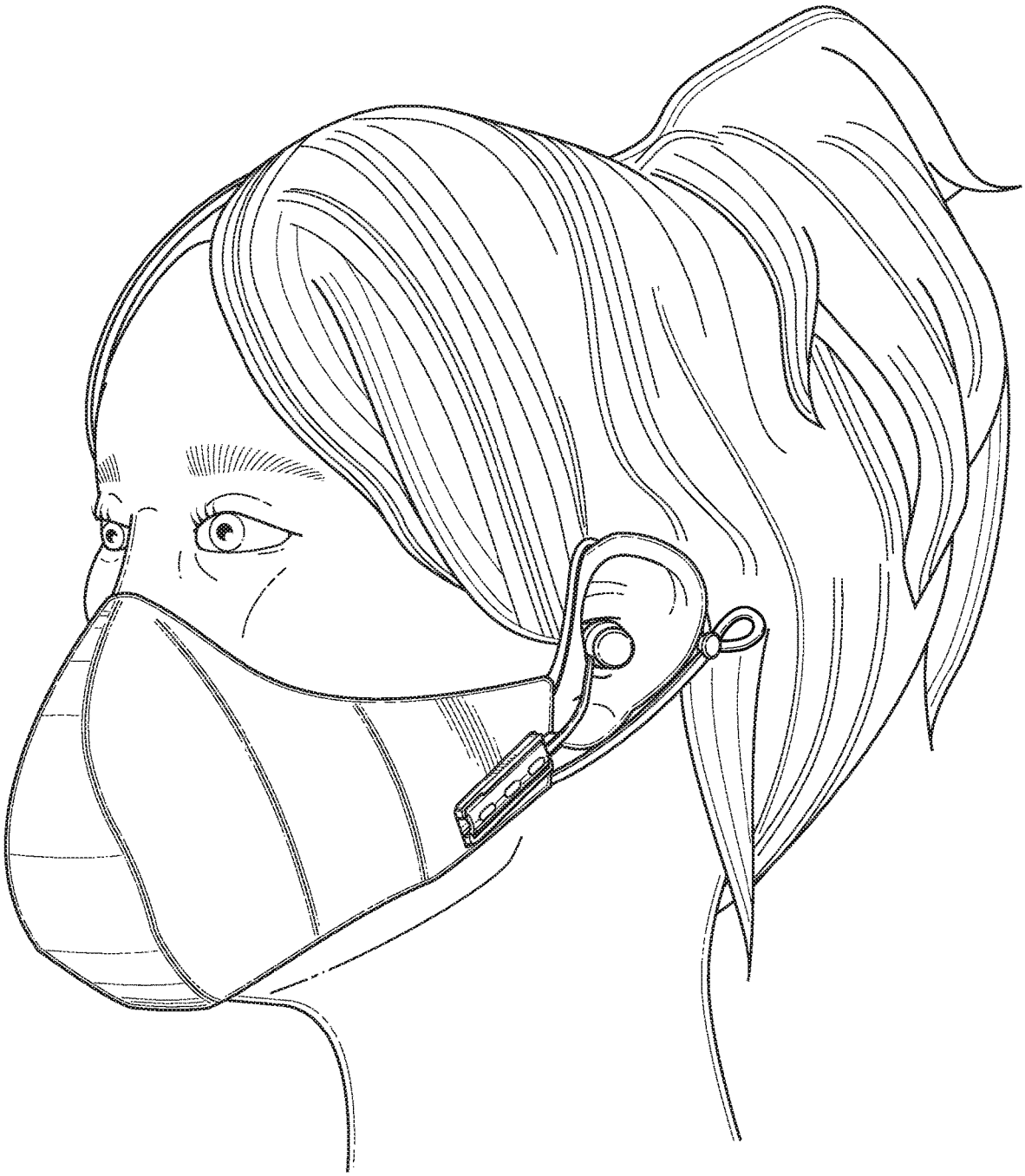

FIG. 9 depicts a perspective view of an individual wearing an exemplary assembled wearable protective respiratory mask having an electronic system with earpieces.

DETAILED DESCRIPTION OF THE INVENTION

A modular, wearable protective respiratory mask is provided for use in at least one setting selected from the group including, but not limited to: a medical setting, a research setting, a laboratory setting, a construction setting, a demolition setting, a smoggy setting, a polluted setting, an emergency setting, an armed conflict setting, a hazardous setting, a noisy setting, a loud setting, and a combination thereof. The mask is configured for use with an electronic system configured for wireless communication with an external electronic system. The external electronic system may be an electronic system associated with a first individual, such as a first individual wearing a first mask as substantially disclosed herein, or it may be an electronic system associated with a second individual, such as a second individual optionally wearing a second mask as substantially disclosed herein. The external electronic system may be, for example, a personal computing system (e.g., a Bluetooth® enabled device, a Wi-Fi® enabled device, a desktop computer, a laptop computer, a tablet computer, a smart phone computer, a smart watch computer, a handheld computer, a private web server, etc.), or a public computing system (e.g., an AM radio station, a FM radio station, a public web server, an emergency response communication system, etc.).

Reference is now made to the drawings, which depict one or more exemplary embodiments of the invention.

Figure 1:
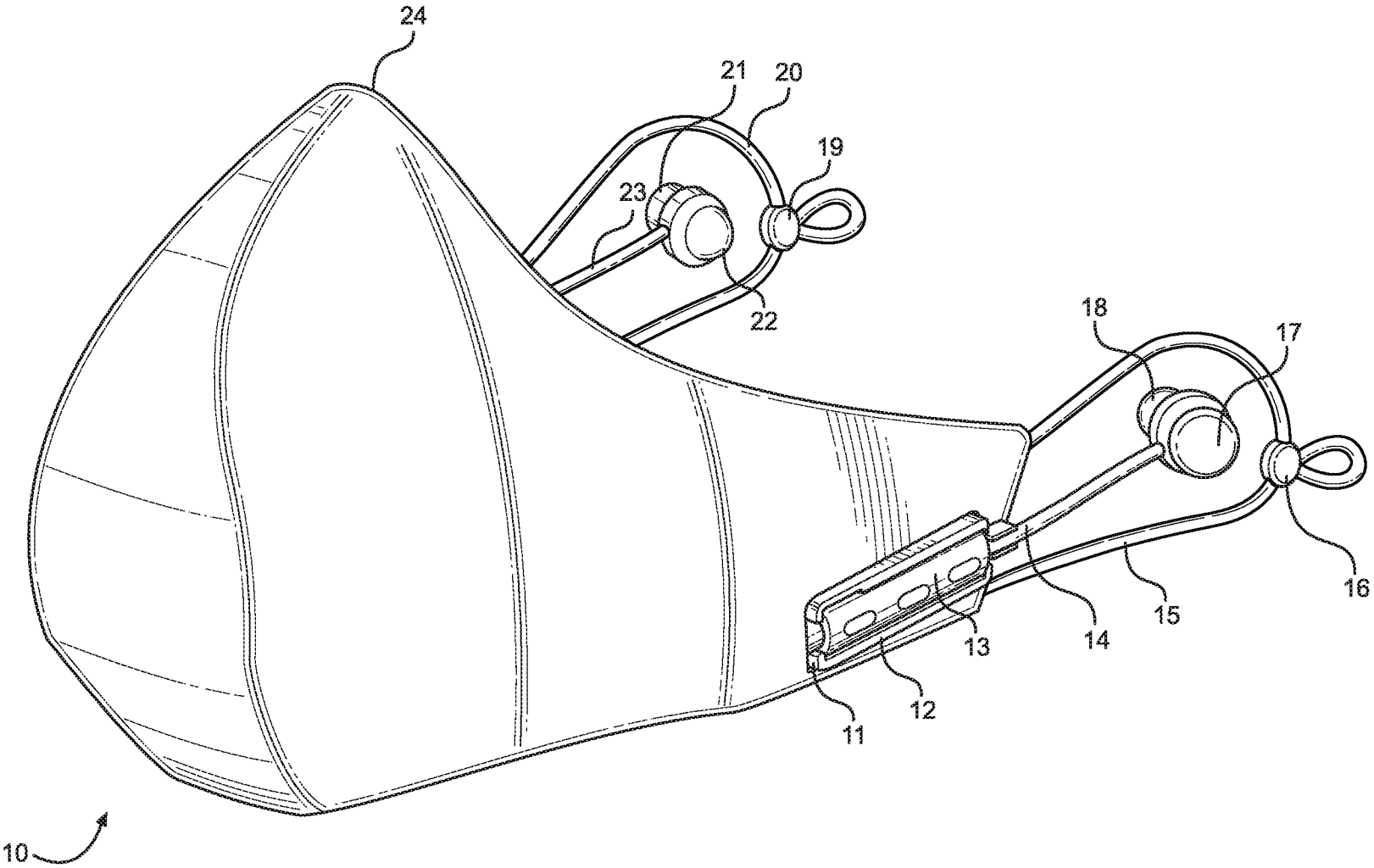
FIG. 1 depicts a first perspective view of an exemplary assembled wearable protective respiratory mask having an electronic system with earpieces.
Figure 2:
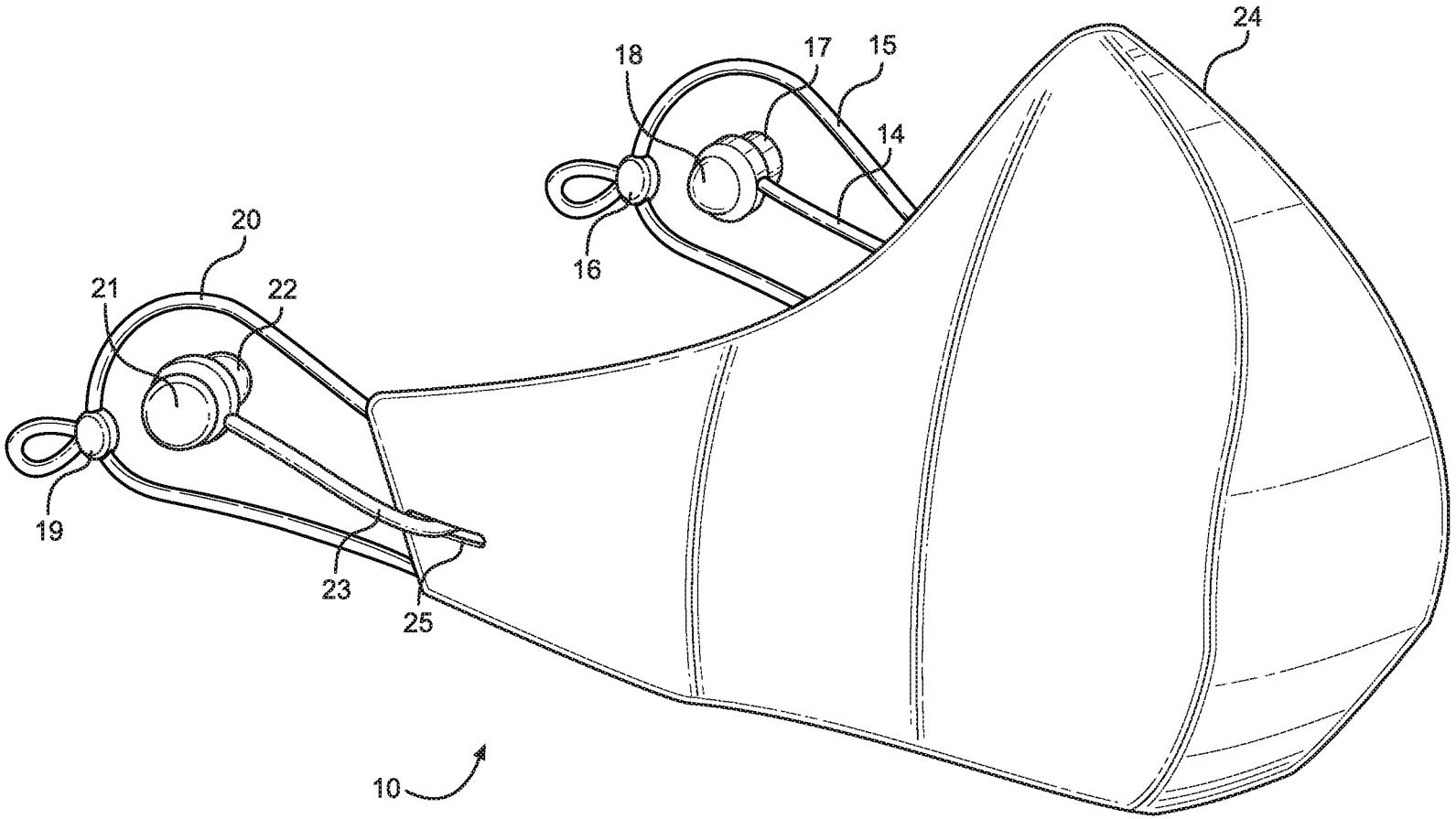
FIG. 2 depicts a second perspective view of an exemplary assembled wearable protective respiratory mask having an electronic system with earpieces.

Referring now to FIGS. 1 and 2, there is depicted a first and a second perspective view, respectively, of an exemplary assembled wearable protective respiratory mask having an electronic system with earpieces. The assembled mask 10 comprises the frame cover 24. The frame cover 24 comprises the optional frame cover control unit opening 11, which provides an opening in the frame cover 24 through which the frame control unit holder 12 protrudes to provide a user easy access to the control unit 13 (FIG. 1). The frame cover 24 also comprises the optional frame cover earpiece opening 25, which provides an opening in the frame cover 24 through which the earpiece cord 23 protrudes to provide a user with the ability to use the electronic system (FIG. 2). There are two earpiece cords 14 and 23 which extend from the control unit 13 and connect with the earpiece 17 and the earpiece 21, respectively. The control unit 13, the earpiece 17, the earpiece 21, or any combination thereof comprises one or more microphones affixed therein or thereon. Two adjustable ear straps 15 and 20 are provided to secure the mask 10 to a user's face. The ear strap 15 comprises the ear strap adjustment bead 16, and the ear strap 20 comprises ear strap adjustment bead 19. The ear strap adjustment beads 16 and 19 are configured to provide sufficient friction with the ear straps 15 and 20, to prevent slippage of the mask when in use. The positions of the ear strap adjustment beads 16 and 19 may be individually adjusted to change the pressure of the mask on the face of a wearer or to accompany a variety of different ear positions relative to a user's face.

Referring now to FIG. 3, there is depicted an exploded view of an exemplary unassembled wearable protective respiratory mask having an electronic system with earpieces. In the example depicted, the ear strap 32 and the ear strap 33 are each removed from the mask frame 27. The exemplary mask comprises the mask frame 27 and a plurality of mask components, comprising optional frame cover 24, outer valve cover 26, valve disc 29, valve frame 30, filter assembly 31, adjustable ear strap 32, adjustable ear strap 33, and electronic system 28. The exemplary mask may be assembled by first placing the outer valve cover 26 into the corresponding opening within the mask frame 27, where the outer valve cover 26 is positioned to engage the valve frame 30. Valve frame 30 engages the outer valve cover 26 and the valve disc 29, such that when the valve frame 30 engages the outer valve cover 26, the valve disc 29 is held in place. The filter assembly 31 is then placed on the valve frame 30, and the ear strap 32 and the ear strap 33 may be attached to the mask frame 27. At this point, the electronic system 28 may be added to the mask frame 27. For certain applications, the optional frame cover 24 may be added to the mask frame 27, such that the optional frame cover control unit opening 11 is directly over the control unit of the electronic system 28.

Referring now to FIG. 4, there is depicted an exploded view of an exemplary unassembled gas filter system. In the example depicted, the dotted lines depict that the outer valve cover 26 reversibly engages with the valve frame 30, reversibly securing in place the valve disc 29. The exemplary gas filter system comprises four pieces: outer valve cover 26, valve disc 29, valve frame 30, and filter assembly 31. The outer valve cover 26 comprises outer valve cover front face 34, which is engaged with outer valve cover rear cylinder 36 by a plurality of outer valve cover arms 35, wherein the plurality of outer valve cover arms 35 forms gaps between outer valve cover front face 34 and outer valve cover rear cylinder 36, which form part of a path for an exhalant from a wearer of the mask to travel if the outer valve cover is in an open position. The valve disc 29 comprises a valve disc circular hole 37 positioned at a center of the valve disc 29, such that the valve disc 29 is configured to reversibly engage with the valve frame 30 by receiving the valve frame inner portion cylinder pin 38, which rests on the valve frame inner portion cylinder 39. The outer valve cover 26, valve disc 29, and valve frame 30 form a one-way valve system. If the one-way valve system is in an open position, exhalant from a wearer exits through the filter assembly opening 47, the exhalant passing through openings in the valve frame inner portion 42 formed by the valve frame inner portion arms 40, around the outer edges of the valve disc 29, and out of the mask through the gaps between outer valve cover front face 34 and outer valve cover rear cylinder 36. If the one-way valve system is in a closed position, the outer valve cover 26 presses the valve disc 29 against circular seal 41, causing exhalant from a wearer to pass through the filter assembly filter mesh 46, the exhalant passing through openings in the valve frame outer portion formed by the valve frame outer portion arms 43, and out of the mask. Regardless of whether the one-way valve system is in an open position or a closed position, inhalant to a wearer passes from outside the mask through openings in the valve frame outer portion formed by the valve frame outer portion arms 43, passing through the filter assembly filter mesh 46, and into the mask. The filter assembly 31 reversibly engages with the valve frame 30 by snap-in mechanism 48. The filter frame 44 comprises a plurality of filter frame arms 45 which form filter frame opening 47. The filter mesh 46 may be configured to filter out solid particulates of any of a range of sizes, chemical substances including polar, non-polar, charged, and non-charged substances, biological substances including saliva, sputum, or mucus, aerosolized viruses or bacteria, and the like. The filter assembly 31 may be changed out for different uses or environments, for replacement after use, or for maintenance of the mask.

Referring now to FIG. 5, there is depicted a detailed view of an exemplary ear strap attachment site, wherein the mask frame surface facing the viewer is a left inner surface of the mask frame. In the example depicted, the ear strap 15 is permanently or semi-permanently attached to the mask frame by way of a top ear strap insert 50 and a bottom ear strap insert 49. The ear strap may be glued, sewn, stitched, or attached by any other permanent or semi-permanent means to the frame.

Referring now to FIG. 6, there is depicted a detailed view of an exemplary ear strap attachment site, wherein the mask frame surface facing the viewer is a right outer surface of the mask frame. In the example depicted, the ear strap 20 is removably attached to the mask frame by way of a top ear strap button 52 and a bottom ear strap button 51. The ear strap may be buttoned, magnetically buttoned, hook-and-loop attached (e.g., Velcro®-attached), or attached by any other non-permanent means to the frame.

Referring now to FIG. 7, there is depicted a perspective view of an exemplary partially assembled wearable protective respiratory mask, wherein the gas filter system is in the open position. Solid arrows represent the path and direction of a gas inhaled from the exterior of the mask to the interior of the mask. Dotted arrows represent the path and direction of a gas exhaled from the interior of the mask to the exterior of the mask. Front electronic system groove 53 is configured to receive a cord of electronic system 28, for example, as part of a connection that extends toward the opposite side of the mask. The mask frame 27 comprises the frame control unit holder 12, which is configured to receive and hold the control unit and associated cords of the electronic system 28 (dotted line).

Referring now to FIG. 8, there is depicted a perspective view of an exemplary partially assembled wearable protective respiratory mask, wherein the gas filter system is in the closed position. Solid arrows represent the path and direction of a gas inhaled from the exterior of the mask to the interior of the mask. Dotted arrows represent the path and direction of a gas exhaled from the interior of the mask to the exterior of the mask.

Referring now to FIG. 9, there is depicted a perspective view of an individual wearing an exemplary assembled wearable protective respiratory mask having an electronic system with earpieces. This exemplary mask has the optional mask cover installed.

In one aspect, the invention provides a wearable protective respiratory mask, comprising a frame configured to engage with a first adjustable ear strap and a second adjustable ear strap. In one embodiment, the frame is configured to engage with a plurality of mask components. In one embodiment, the plurality of mask components comprises a gas filter system, and an electronic system. In one embodiment, the gas filter system comprises a plurality of gas filter system components.

In one embodiment, the gas filter system is configured to be in an open configuration by adjusting at least one component of the gas filter system in a first direction, and the gas filter system is configured to be in a closed configuration by adjusting the at least one component of the gas filter system in a second direction. In one embodiment, if the gas filter system is in the open configuration, the gas filter system filters gas entering an interior of the mask from an exterior of the mask, and the gas filter system does not filter gas entering the exterior of the mask from the interior of the mask. In one embodiment, if the gas filter system is in the closed configuration, the gas filter system filters gas entering the interior of the mask from the exterior of the mask, and the gas filter system filters gas entering the exterior of the mask from the interior of the mask.

In one embodiment, the frame is constructed of a material that is thermally stable and maintains structure through one or more autoclave procedures. In one embodiment, the frame is constructed of a material comprising at least one component selected from the group including, but not limited to: an elastomer, a rubber, a silicon, and a combination thereof. In one embodiment, the first adjustable ear strap is constructed of a material that is elastic. In one embodiment, the second adjustable ear strap is constructed of a material that is elastic. In one embodiment, the gas filter system is constructed of at least one material that comprises at least one component selected from the group including, but not limited to: a polymer, a plastic, a metal, an alloy, a rubber, and a combination thereof.

In one embodiment, the frame is configured to reversibly engage with the first adjustable ear strap, and the frame is configured to reversibly engage with the second adjustable ear strap. In one embodiment, the frame is configured to reversibly engage with the plurality of mask components. In one embodiment, the frame provides a basic structure on which the plurality of mask components may be reversibly attached. In one embodiment, the frame and the plurality of mask components are durable and reusable. In one embodiment, the frame and the plurality of mask components may be easily disassembled to facilitate maintenance and cleaning.

In one embodiment, the plurality of mask components comprises a frame cover. In one embodiment, the frame cover is constructed of a material that is stretchable or flexible. In one embodiment, the frame cover is constructed of a material comprising at least one component selected from the group including, but not limited to: a textured fabric, a polyurethane (PU) fabric, a silicon, and a combination thereof. In one embodiment, the frame cover is constructed by a method comprising sewing. In one embodiment, the frame cover is constructed by a method comprising molding. In one embodiment, the frame cover is perforated. In one embodiment, the frame cover is a multiple-use frame cover, which may be reused one or more times. In one embodiment, the frame cover is a single-use frame cover.

In one embodiment, the gas filter system comprises a plurality of gas filter system components, comprising: an outer valve cover, a valve disc, a valve frame, and a filter assembly. In one embodiment, each component of the plurality of gas filter components is configured to reversibly engage with at least one other component of the plurality of gas filter components. In one embodiment, the gas filter system is opened by rotating at least one component of the gas filter system in a first circular direction, and the gas filter system is closed by rotating at least one component of the gas filter system in a second circular direction. In one embodiment, the at least one component comprises an outer valve cover reversibly engaged with a valve frame. In one embodiment, rotation of the outer valve cover in the clockwise or counter-clockwise direction moves the outer valve cover inward (closing the valve system) or outwards (opening the valve system), respectively. In one embodiment, the outer valve cover engages with a plurality of threads located on a surface of an enclosure of the valve frame, on which the outer valve cover may be rotated by a user or wearer. In one embodiment, the outer valve cover and the valve disc interact with the valve frame, and the valve frame interacts with the filter assembly. In one embodiment, the gas filter system is configured to reversibly engage with the mask frame. In one embodiment, the gas filter system is scented. In one embodiment, the gas filter system is scented with at least one selected from the group including, but not limited to: lavender, lavender extract, essence of lavender, and a combination thereof.

In one embodiment, each component of the plurality of gas filter components is configured to reversibly engage with at least one other component of the plurality of gas filter components. In one embodiment, the gas filter components may be easily disassembled to facilitate maintenance and cleaning. In one embodiment, the gas filter components are substantially reusable. In one embodiment, the filter assembly may be replaced, for example, after a certain amount of time or after a certain amount of usage of the mask.

In one embodiment, the outer valve cover comprises an outer valve cover front face engaged with an outer valve cover rear cylinder by a plurality of outer valve cover arms, wherein the plurality of outer valve cover arms forms two or more gaps between the outer valve cover front face and the outer valve cover rear cylinder. In one embodiment, the two or more gaps form part of a path for an exhalant from a wearer of the mask to travel if the outer valve cover is in an open position. In one embodiment, the outer valve cover comprises two outer valve cover arms. In one embodiment, the outer valve cover comprises three outer valve cover arms. In one embodiment, the outer valve cover comprises four outer valve cover arms. In one embodiment, the outer valve cover comprises five or more outer valve cover arms. In one embodiment, the valve disc comprises a valve disc circular hole positioned at a center of the valve disc. In one embodiment, the valve frame comprises a valve frame outer portion engaged with a valve frame inner portion by a plurality of valve frame middle arms. In one embodiment, the plurality of valve frame middle arms forms two or more gaps between the valve frame outer portion and the valve frame inner portion. In one embodiment, the two or more gaps form part of a path for an exhalant from a wearer of the mask to travel if the outer valve cover is in a closed position. In one embodiment, the valve frame inner portion forms part of a path for an exhalant from a wearer of the mask to travel if the outer valve cover is in an open position. In one embodiment, the valve frame comprises two valve frame middle arms. In one embodiment, the valve frame comprises three valve frame middle arms. In one embodiment, the valve frame comprises four valve frame middle arms. In one embodiment, the valve frame comprises five or more valve frame middle arms. In one embodiment, the valve frame inner portion comprises a plurality of valve frame inner portion arms connected to a valve frame inner portion cylinder having a first radius, wherein the valve frame inner portion cylinder comprises a valve frame inner portion cylinder pin having a second radius, wherein the second radius is smaller than the first radius, wherein the valve frame inner portion cylinder pin is configured to engage with the valve disc circular hole. In one embodiment, the valve frame inner portion comprises three valve frame inner portion arms. In one embodiment, the valve frame inner portion comprises four valve frame inner portion arms. In one embodiment, the valve frame inner portion comprises five or more valve frame inner portion arms. In one embodiment, the valve frame inner portion is in the closed position such that the valve disc is pressed against a circular seal of the valve frame inner portion, by closing of the outer valve cover. In one embodiment, the valve frame inner portion is in the open position such that the valve disc is not pressed against a circular seal of the valve frame inner portion, by opening of the outer valve cover. In one embodiment, the filter assembly comprises a filter frame and a filter mesh, wherein the filter frame is configured to engage the filter mesh and the valve frame. In one embodiment, the filter frame is configured to engage the valve frame by way of a snap-in mechanism. In one embodiment, the filter frame is engaged to the filter mesh to form a singular filter assembly. In one embodiment, the filter assembly is reusable. In one embodiment, the filter assembly is not reusable.

In one embodiment, the electronic system comprises a power source, a microphone, a first earpiece electrically connected to a control unit, and a second earpiece electrically connected to the control unit; wherein the control unit alters at least one activity of the electronic system. In one embodiment, the power source comprises one or more batteries. In one embodiment, the microphone is positioned near at least one selected from the group including, but not limited to: the first earpiece, the second earpiece, the control unit, and a combination thereof.

In one embodiment, the first earpiece comprises a first speaker, and the second earpiece comprises a second speaker. In one embodiment, the volume of the first speaker is controlled by electrical signals from the control unit. In one embodiment, the volume of the second speaker is controlled by electrical signals from the control unit. In one embodiment, the volume of the first speaker is controlled by electrical signals from the control unit, and the volume of the second speaker is controlled by electrical signals from the control unit. In one embodiment, the control unit alters at least one activity selected from the group including, but not limited to: delivery of power from the power source to the electronic system, delivery of electrical signals to the first speaker, delivery of electrical signals to the second speaker, and a combination thereof. In one embodiment, the control unit alters a sending of a radio signal by the electronic system. In one embodiment, the control unit alters a receiving of a radio signal by the electronic system.

In one embodiment, the electronic system comprises a first radio transceiver configured to receive a first radio signal from at least a first external electronic system and transmit the first radio signal to at least one selected from the group consisting of: the first speaker, the second speaker, and a combination thereof.

In one embodiment, the electronic system comprises a second radio transceiver configured to receive a second radio signal from at least the microphone and transmit the second radio signal to at least the first external electronic system.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the instant invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A wearable protective respiratory mask, comprising:

a first adjustable ear strap and a second adjustable ear strap;

a plurality of mask components; and a frame configured to engage with the first adjustable ear strap and the second adjustable ear strap;

wherein the frame is configured to reversibly engage with the plurality of mask components;

wherein the plurality of mask components comprises a gas filter system and an electronic system;

wherein the gas filter system comprises a plurality of gas filter system components;

wherein the gas filter system may be in either an open configuration, wherein the gas filter system is configured to filter gas entering an interior of the mask from an exterior of the mask and not filter gas entering the exterior of the mask from the interior of the mask, or a closed configuration, wherein the gas filter system is configured to filter gas entering the interior of the mask from the exterior of the mask and filter gas entering the exterior of the mask from the interior of the mask;

wherein the gas filter system is configured to be placed in the open configuration by adjusting at least one component of the gas filter system in a first direction such that a valve within the gas filter system is openable to allow gas to flow therethrough, and wherein the gas filter system is configured to be placed in the closed configuration by adjusting the at least one component of the gas filter system in a second direction such that the valve within the gas filter system is not openable to allow gas to flow therethrough.

2. The wearable protective respiratory mask of claim 1, wherein the frame is configured to reversibly engage with the first adjustable ear strap, and wherein the frame is configured to reversibly engage with the second adjustable ear strap.

3. The wearable protective respiratory mask of claim 1, wherein the plurality of mask components comprises a frame cover.

4. The wearable protective respiratory mask of claim 1, wherein the plurality of gas filter system components comprises an outer valve cover, a valve disc, a valve frame, and a filter assembly.

5. The wearable protective respiratory mask of claim 4, wherein each component of the plurality of gas filter components is configured to reversibly engage with at least one other component of the plurality of gas filter components.

6. The wearable protective respiratory mask of claim 5, wherein the outer valve cover comprises an outer valve cover front face engaged with an outer valve cover rear cylinder by a plurality of outer valve cover arms, wherein the plurality of outer valve cover arms forms two or more gaps between the outer valve cover front face and the outer valve cover rear cylinder;

wherein the valve disc comprises a valve disc circular hole positioned at a center of the valve disc;

wherein the valve frame comprises a valve frame outer portion engaged with a valve frame inner portion by a plurality of valve frame middle arms, wherein the plurality of valve frame middle arms forms two or more gaps between the valve frame outer portion and the valve frame inner portion;

wherein the valve frame inner portion comprises a plurality of valve frame inner portion arms connected to a valve frame inner portion cylinder having a first radius, wherein the valve frame inner portion cylinder comprises a valve frame inner portion cylinder pin having a second radius, wherein the second radius is smaller than the first radius, wherein the valve frame inner portion cylinder pin is configured to engage with the valve disc circular hole;

wherein the filter assembly comprises a filter frame and a filter mesh, wherein the filter frame is configured to engage the filter mesh and the valve frame.

7. The wearable protective respiratory mask of claim 1, wherein the electronic system comprises a power source, a microphone, a first earpiece electrically connected to a control unit, and a second earpiece electrically connected to the control unit; wherein the control unit is configured to alter at least one activity of the electronic system.

8. The wearable protective respiratory mask of claim 7, wherein the first earpiece comprises a first speaker, and the second earpiece comprises a second speaker; wherein the control unit is configured to alter at least one activity selected from the group consisting of: delivery of power from the power source to the electronic system, delivery of electrical signals to the first speaker, delivery of electrical signals to the second speaker, and a combination thereof.

9. The wearable protective respiratory mask of claim 8, wherein the electronic system comprises a first radio transceiver configured to receive a first radio signal from at least a first external electronic system and transmit the first radio signal to at least one selected from the group consisting of: the first speaker, the second speaker, and a combination thereof.

10. The wearable protective respiratory mask of claim 9, wherein the electronic system comprises a second radio transceiver configured to receive a second radio signal from at least the microphone and transmit the second radio signal to at least the first external electronic system.

* * * * *